US009774969B2

(12) United States Patent
Matsumoto

(10) Patent No.: US 9,774,969 B2
(45) Date of Patent: Sep. 26, 2017

(54) MICROPHONE CONNECTING DEVICE

(71) Applicant: KABUSHIKI KAISHA AUDIO-TECHNICA, Machida-shi, Tokyo (JP)

(72) Inventor: Akira Matsumoto, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 15/053,576

(22) Filed: Feb. 25, 2016

(65) Prior Publication Data

US 2016/0255450 A1 Sep. 1, 2016

(30) Foreign Application Priority Data

Feb. 26, 2015 (JP) ..... 2015-036927

(51) Int. Cl.

| | |
|---|---|
| ***H04R 29/00*** | (2006.01) |
| ***H03G 3/20*** | (2006.01) |
| ***H03F 99/00*** | (2009.01) |
| ***H04R 3/00*** | (2006.01) |
| ***H04R 1/02*** | (2006.01) |
| *H04R 19/04* | (2006.01) |
| *H04R 27/00* | (2006.01) |

(52) U.S. Cl.

CPC ..... *H04R 29/004* (2013.01); *H04R 1/028* (2013.01); *H04R 19/04* (2013.01); *H04R 27/00* (2013.01); *H04R 2420/00* (2013.01)

(58) Field of Classification Search

CPC .... H04R 29/004; H04R 1/02; H04R 2420/00; H04R 1/04; H04R 1/08

USPC ..... 381/58, 174, 122, 91, 172, 120, 56, 57, 381/363, 361

See application file for complete search history.

(56) References Cited

U.S. PATENT DOCUMENTS

| | | | | |
|---|---|---|---|---|
| 7,168,965 | B2 * | 1/2007 | Akino | H04R 19/04 439/349 |
| 9,247,333 | B2 * | 1/2016 | Akino | H04R 1/08 |
| 2002/0186855 | A1 | 12/2002 | Akino et al. | |

(Continued)

FOREIGN PATENT DOCUMENTS

| | | | |
|---|---|---|---|
| JP | 2005-94575 | A | 4/2005 |
| JP | 2011-101318 | A | 5/2011 |

OTHER PUBLICATIONS

Europe Patent Office, "Search Report for European Patent Application No. 16157566.7," dated May 17, 2016.

*Primary Examiner* — Thjuan K Addy
(74) *Attorney, Agent, or Firm* — Manabu Kanesaka

(57) ABSTRACT

A microphone amplifier unit, to which a microphone of a first form including an LED or a microphone of a second form without including an LED is connected, includes a microphone detecting unit that detects a connection state of the microphone of the first form or the second form based on potential information supplied to a specific terminal pin of a connector. In the microphone amplifier unit, appropriate circuit setting corresponding to functions of the respective microphones is made based on information obtained by the microphone detecting unit. With the configuration, a microphone connecting device that can commonly use the microphone of the first form and the microphone of the second form with a small number of pins is provided.

6 Claims, 5 Drawing Sheets

(56) References Cited

U.S. PATENT DOCUMENTS

| | | | | |
|---|---|---|---|---|
| 2007/0230717 | A1 | 10/2007 | Akino | |
| 2015/0092975 | A1* | 4/2015 | Akino | H04R 1/08<br>381/355 |

* cited by examiner

MICROPHONE CONNECTING DEVICE

BACKGROUND OF THE INVENTION

Field of the Invention

The present invention realizes control of a notifying unit in a microphone including the notifying unit by remote control, for example, and relates to a microphone connecting device that enables an existing microphone without including the notifying unit to commonly use a balanced-output system of signals.

Description of the Related Art

For example, as conference microphones respectively installed on speech tables of conference rooms or tables of conference attendees, gooseneck-type microphones are provided. The gooseneck-type microphones include a stand arm with a long neck made of a flexible pipe that easily enables angle and height adjustment. A microphone unit case which accommodates a microphone unit is attached to a distal portion of the stand arm.

As the gooseneck-type microphones, typically, a small and light condenser microphone is used. A phantom power feeding system which supplies operating power for an impedance converter of the condenser microphone through the signal lines of the microphone from the microphone amplifier unit is employed.

For the above-described microphones installed in conference rooms, for example, a gooseneck-type microphone including a light emitting body (hereinafter, also called LED) is provided on a main body of the microphone as a notifying unit for making smooth progress of conferences. In such a gooseneck-type microphone, the LED is turned on remotely by an operator, for example, and notifies a speaker that the microphone is in an ON state where the audio signal can be taken in by selection control of the audio signal.

By the way, the above-described conventional condenser microphone without an LED typically incorporates a three-pin type output connector. A microphone cable is attachably/detachably connected to the output connector. As the output connector, a connector defined in EIAJ RC-5236 "A latch lock-type round connector for acoustic devices" is used.

This connector includes a first pin for grounding, a second pin assigned to a hot side of a signal, and a third pin assigned to a cold side of the signal. Such a three-pin type output connector is disclosed in JP 2005-94575 A.

Meanwhile, as for the above-described microphone including the LED on the main body of the microphone, a microphone having an output connector in which a pin for LED control is added to the above-described pins configuration has been conventionally proposed. For such a conventional microphone, lighting control of the LED included on the main body of the microphone can remotely be performed from a microphone amplifier unit.

Further, similarly to the condenser microphone without including an LED, a condenser microphone including an LED connectable in EIAJ RC-5236 has been also proposed. However, this condenser microphone including an LED is configured such that a voltage for driving the LED is applied to the entire housing of the microphone. The housing of the microphone is coated with paint for insulation to prevent a user from getting an electric shock when normally used. However, when removal of the paint, for example, occurs due to repetitive use, the user may possibly get an electric shock by the microphone with this configuration.

As described above, normally, the numbers of pins of the output connectors are different for the microphone including an LED at the microphone main body and the microphone without including an LED. Therefore, sockets of the output connectors are different and common use is not compatible. That is, normally, the former condenser microphone including an LED at the microphone main body and the latter condenser microphone without including an LED are unusable in a mixed manner.

Further, even if the number of pins of the output connector of the microphone including an LED is the same as that of the microphone without including an LED, voltage/current for driving the LED are applied to the housing of the microphone, and thus there is a problem of lack of safety.

Therefore, it is an important issue to provide versatility in a case where a failure occurs in the former microphone including an LED, for example, so that the latter microphone without including an LED can be used in place of the former microphone. Further, a connection configuration of a microphone or a method of connecting a microphone is desired for using the microphone including an LED safely even if the microphone including an LED has the same number of pins as that of a microphone without including an LED.

SUMMARY OF THE INVENTION

The present invention has been made to solve the above-described problems, and the present invention commonly uses the output connectors of the former and latter condenser microphones with a small number of pins, realizes balanced output of output signals from the condenser microphones, and enables use of phantom power supply. Then, an objective of the present invention is to provide a microphone connecting device that can identify the former and latter condenser microphones at the side of a microphone amplifier unit that receives the output signals of the microphones, and can set the former microphone including an LED to a mode that enables lighting control of the LED.

A microphone connecting device according to an embodiment of the present invention, which has been made to solve the above-described problems, includes a connector including a terminal pin that connects a microphone, a microphone detecting unit configured to detect whether a notifying unit is mounted in the microphone, and a control unit configured to control connection of the microphone based on a detection signal from the microphone detecting unit.

In this case, the microphone detecting unit is configured to output the detection signal based on potential information appearing in a specific terminal pin of the connector.

Further, in a preferred form, the microphone detecting unit is configured to output a first detection signal due to the microphone including the notifying unit having been connected to the connector, and the control unit is configured to operate an operation circuit of the notifying unit by receiving the first detection signal.

Further, in a preferred form, a short circuit configured to short-circuit the specific terminal pin of the connector is included, and the microphone detecting unit outputs a second detection signal due to a microphone without including the notifying unit having been connected to the connector, and the control unit sets the short circuit to be operable by receiving the second detection signal.

Then, an operation circuit of the notifying unit connects the specific terminal pin to the ground to operate the notifying unit, and releases the ground connection of the specific terminal pin to stop the operation of the notifying unit.

Further, preferably, a power feed circuit configured to supply a phantom power supply is further included, and notifying unit drive power is supplied from the power feed circuit to the notifying unit.

Further, a hot-side signal line and a cold-side signal line are further connected to the connector, an audio signal from the microphone is balanced-output using the hot-side signal line and the cold-side signal line, and a phantom power feed circuit is configured in which power from the power feed circuit is equally divided into the hot-side signal line and the cold-side signal line and is sent to the microphone.

In addition, the connector includes three terminal pins.

Further, the notifying unit is preferably a light emitting body, and as an operation circuit of the notifying unit, a lighting circuit that lights the light emitting body is included.

Further, a preferred form of a microphone connecting device according to the present invention is a microphone connecting device suitable to be connected to a microphone of a first form in which a light emitting body is mounted, and a microphone of a second form in which a light emitting body is not mounted, the microphone connecting device including a microphone amplifier unit configured to receive audio signals from the microphones of the first and second forms, and a connector including a terminal pin suitable to connect the microphone amplifier unit and the microphones of the first and second forms, in which the microphone amplifier unit includes a power feed circuit suitable to supply a direct current power supply to the microphones of the first and second forms, a microphone detecting unit configured to detect a connection state of the microphone of the first form or the microphone of the second form based on potential information from the direct current power supply supplied to a specific terminal pin of the connector, and a control unit configured to set a lighting circuit of the light emitting body to be operable by detecting connection of the microphone of the first form, and configured to connect the specific terminal pin of the connector to the ground by detecting connection of the microphone of the second form, by the microphone detecting unit.

Then, drive power is supplied from the power feed circuit in the microphone amplifier unit to an impedance conversion circuit and the light emitting body in the microphone of the first form connected to the microphone connecting device.

The microphone connecting device with the above configuration includes the microphone detecting unit that detects connection of either the microphone of the first form in which the light emitting body is mounted or the microphone of the second form in which the light emitting body is not mounted based on the potential information of the specific terminal pin of the connector.

Then, when the connection of the microphone of the first form has been detected, an operation to set the lighting control circuit of the light emitting body to be operable is performed, and when the connection of the microphone of the second form has been detected, an operation to connect the specific terminal pin of the connector to the ground is performed. Accordingly, the microphone connecting device that can perform appropriate circuit setting corresponding to respective functions of the microphones of the first and second forms can be provided.

DESCRIPTION OF THE PREFERRED EMBODIMENTS

Figure 1:
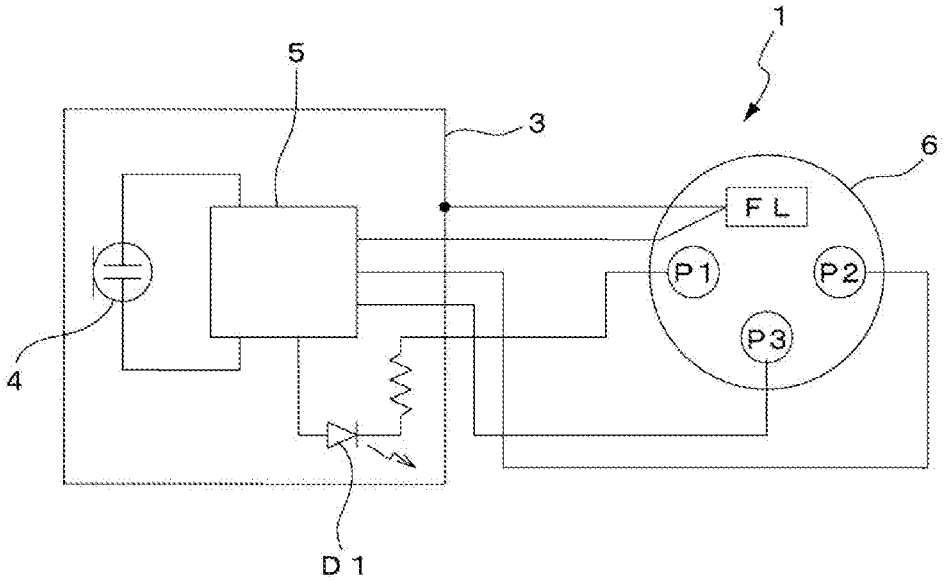
FIG. 1 is a block diagram illustrating a microphone of a first form used in a microphone connecting device according to an embodiment of the present invention.

Hereinafter, a microphone connecting device according to the present invention will be described based on embodiments illustrated in the drawings.

First, FIG. 1 is a block diagram illustrating a microphone of a first form in which a light emitting body (LED) is mounted as a notifying unit. In the microphone 1 of the first form, a condenser microphone unit 4 and a circuit configuration unit 5 are accommodated in a microphone unit case 3.

An impedance converter of the condenser microphone unit 4 and a power supply circuit described below, for example, are accommodated in the circuit configuration unit 5. Further, an LED is arranged in the microphone unit case 3, for example, as a light emitting body D1. An anode of the LED is connected to the power supply circuit in the circuit configuration unit 5, and a cathode of the LED is connected to a first pin P1 of an output connector 6.

The microphone 1 illustrated in FIG. 1 configures a gooseneck-type microphone, for example. The output connector 6 is attached to a base end portion of a stand arm (not illustrated) that configures the gooseneck-type microphone. Then, a connection line between the microphone unit case 3 attached to a distal portion of the stand arm and the output connector 6 is accommodated inside the stand arm. Further, the microphone unit case 3 is connected to a frame ground terminal FL of the output connector 6 through the metal stand arm.

In the microphone 1 of the first form illustrated in FIG. 1, a second pin P2 of the output connector 6 is assigned to a hot side of a signal, and a third pin P3 is assigned to a cold side of the signal. Further, a ground line of the signal is connected to the frame ground terminal FL of the output connector 6, and thereby the microphone is configured to output the signal in the form of a balanced-output. That is, although a three-pin type connector is used in the output connector 6 of the microphone 1 of the first form, an existing connecting metal tool that connects the first pin P1 and the frame ground terminal FL is removed, and the first pin P1 and the frame ground terminal FL are electrically separated.

Figure 4:
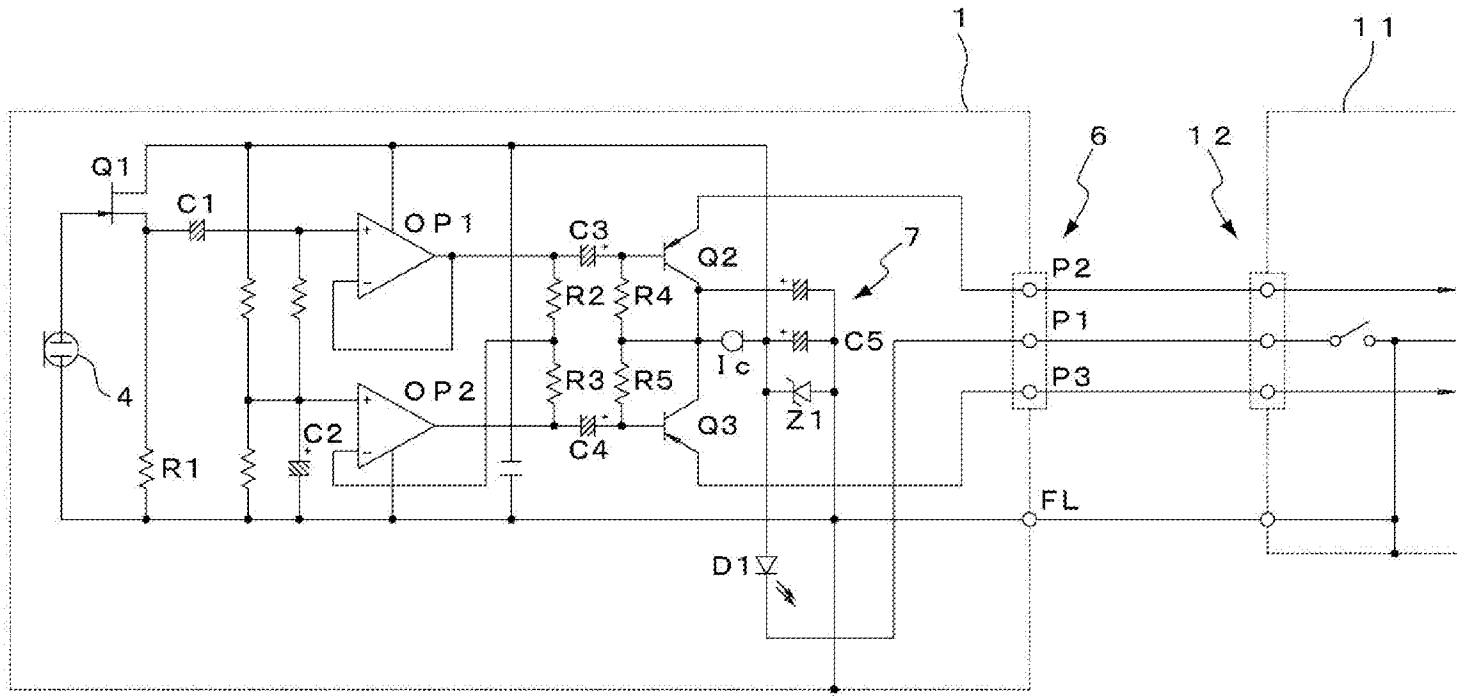
FIG. 4 is a circuit configuration diagram illustrating a specific example of the microphone of the first form illustrated in FIG. 1.

FIG. 4 illustrates a circuit configuration of the microphone 1 of the first form illustrated in FIG. 1. The microphone unit 4 included in the microphone 1 configures an electret condenser microphone unit including an electret layer in either a facing diaphragm or a fixed electrode.

Then, the fixed electrode is connected to a gate of a field effect transistor (Q1) that functions as the impedance converter, and the diaphragm is connected to a ground line of the microphone 1. Further, a direct current operation voltage is supplied from a constant voltage circuit described below to a drain of the field effect transistor (Q1), and a source resistance R1 is connected to a source thereof. That is, the field effect transistor (Q1) configures a source follower circuit.

A coupling condenser C1 is connected to the source of the field effect transistor (Q1). A signal, subjected to impedance conversion, from the condenser microphone unit 4 is derived through the coupling condenser C1. This signal is supplied to a non-inverting input terminal of a first operational amplifier OP1. An input resistance R2 of a second operational amplifier OP2 is connected to an output terminal of the first operational amplifier OP1, and the other end of the input resistance R2 is connected to an inverting input terminal of the second operational amplifier OP2. Then, a non-inverting input terminal of the second operational amplifier OP2 is connected to the ground through a condenser C2. Further, a feedback resistance R3 is connected between the inverting input terminal and an output terminal of the second operational amplifier OP2.

A value of the input resistance R2 and a value of the feedback resistance R3 are set to be equal, so that the second operational amplifier OP2 configures an inverting amplifier with a voltage amplification factor of −1.

Therefore, an output of the first operational amplifier OP1 and an output of the second operational amplifier OP2 are generated based on the signal obtained by the condenser microphone unit 4, and are in a relationship of mutually opposite phases (in a balanced-output state). Balanced output signals are supplied to bases of transistors Q2 and Q3 through coupling condensers C3 and C4, respectively.

The transistor Q2 configures a first emitter follower circuit including a bias setting resistance R4. An output of the first emitter follower circuit is supplied to the second pin P2 of the output connector 6, as a hot-side output of a signal. Further, the transistor Q3 configures a second emitter follower circuit including a bias setting resistance R5. An output of the second emitter follower circuit is supplied to the third pin P3 of the output connector 6, as a cold-side output of a signal.

Further, a direct current power supply from a power feed circuit included in a microphone amplifier unit 11 described below is equally divided to the hot side and the cold side and sent to the microphone through the second pin P2 and the third pin P3 of the output connector 6 that balanced-outputs signals. Accordingly, a phantom power feed circuit is configured.

A direct current from the phantom power feed circuit is supplied to a commonly connected collector of the transistors Q2 and Q3 that configure the first and second emitter follower circuits. Then, a constant current element Ic is connected to the commonly connected collector. Further, a constant voltage element Z1 and a condenser C5 are connected in parallel between the constant current element Ic and the ground line. These constant voltage element Z1 and condenser C5 configure a power supply circuit (constant voltage circuit) 7, and supply a drive voltage to the field effect transistor (Q1), and the first and second operational amplifiers OP1 and OP2.

Meanwhile, as illustrated in FIG. 1, the LED (light emitting diode D1) is mounted in the microphone of the first form illustrated in FIG. 4. The anode of the LED (D1) as the notifying unit is connected to the power supply circuit 7, and the cathode of the LED (D1) is connected to the first pin P1 of the output connector 6.

Note that, as illustrated in FIG. 4, the output connector 6 of the microphone 1 and a connector 12 provided in the microphone amplifier unit 11 are connected by a connection line that connects a known balanced shield cable and the frame ground terminal FL.

Such connection between the output connector 6 and the connector 12 enables to output signals as a balanced-output and configures a phantom power supply to be described below feeding dc power from the microphone amplifier unit 11 to the microphone 1.

Figure 2:
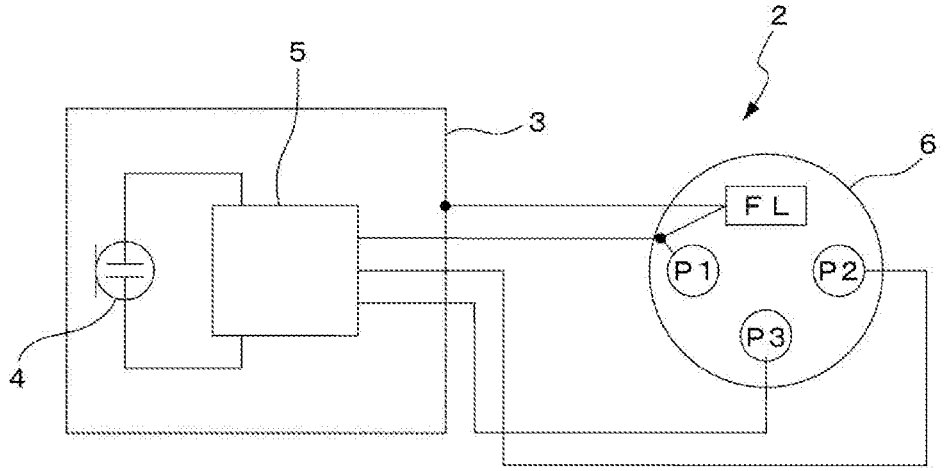
FIG. 2 is a block diagram similarly illustrating a microphone of a second form.

Next, FIG. 2 is a block diagram illustrating a microphone of a second form. This microphone 2 of the second form configures a gooseneck-type microphone, similarly to the microphone of the first form. Then, compared with the microphone 1 of the first form, a light emitting diode D1 (LED) as a notifying unit is not mounted in the microphone 2 of the second form, but other principal configurations are similar to those of the microphone 1 of the first form. Therefore, a portion serving the same function is denoted with the same reference sign, and individual description is omitted.

Further, the microphone 2 of the second form also uses a three-pin type output connector 6. However, a frame ground terminal FL and a first pin P1 are electrically connected with an existing connecting metal tool.

Figure 5:
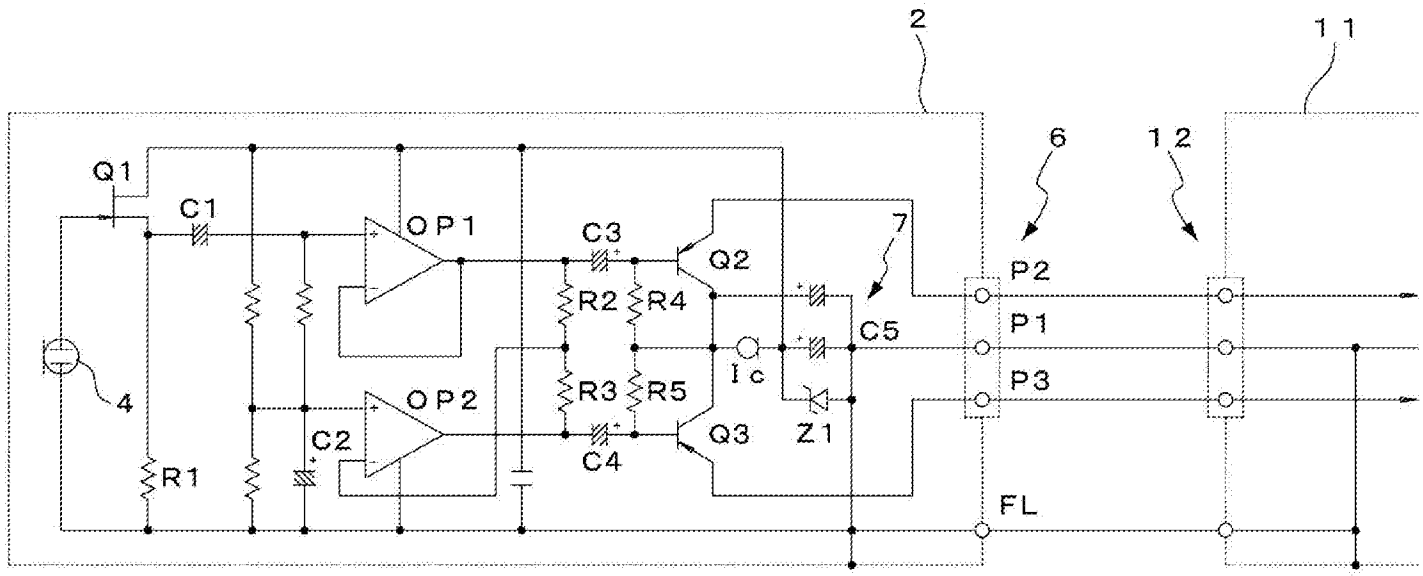
FIG. 5 is a circuit configuration diagram illustrating a specific example of the microphone of the second form illustrated in FIG. 2.

FIG. 5 illustrates a circuit configuration of the microphone 2 of the second form illustrated in FIG. 2. In the circuit configuration illustrated in FIG. 5, principal portions thereof are similar to those of the example illustrated in FIG. 4. Therefore, a portion serving the same function is denoted with the same reference sign, and individual description is omitted.

As illustrated in FIG. 5, in the microphone 2 of the second form, the first pin P1 of the output connector 6 functions as a ground line of a signal. Then, balanced-output signals from the microphone 2 are output to a microphone amplifier unit 11 as a hot-side signal and a cold-side signal through a second pin P2 and a third pin P3 of the output connector 6, respectively. Further, from the microphone amplifier unit 11, equally-divided direct current power is sent to a power supply circuit 7 of the microphone 2 using the second pin P2 and the third pin P3 of the output connector 6, as described below. Accordingly, a phantom power feed circuit is configured.

Figure 3:
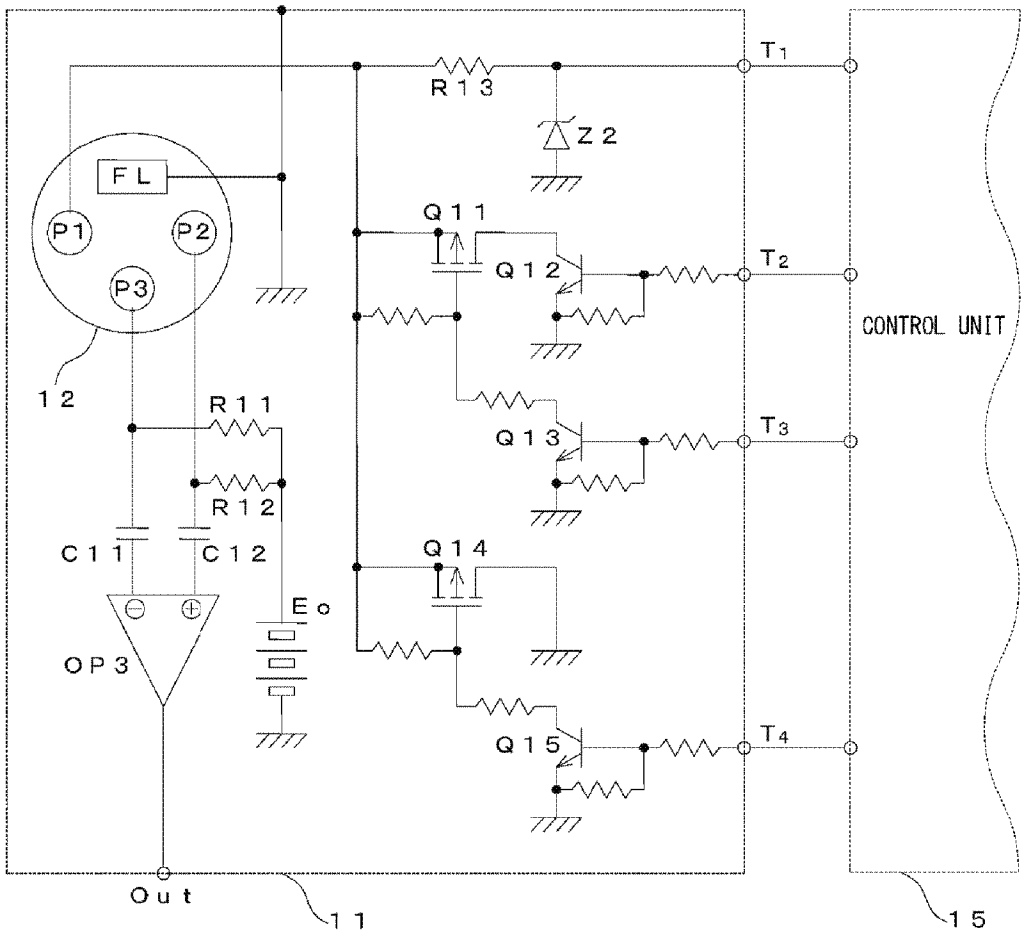
FIG. 3 is a circuit configuration diagram similarly illustrating a configuration of a microphone amplifier unit as an example of the microphone connecting device.

FIG. 3 illustrates a configuration of a connecting device of a microphone, for example, the microphone amplifier unit 11, to which the microphone 1 of the first form or the microphone 2 of the second form is appropriately connected. This microphone amplifier unit 11 also includes the three-pin type connector 12. Then, a frame ground terminal FL of the connector 12 is connected to a metal case of the microphone amplifier unit 11, and also functions as a ground line of a signal.

A second pin P2 and a third pin P3 of the connector 12 are connected to a non-inverting input terminal and an inverting input terminal of an operational amplifier OP3 that configures a differential amplification circuit through direct current cut condensers C11 and C12, respectively. With the configuration, calculation processing (for example, subtraction processing) is applied to a balanced-output signal from the microphone of the first or second form, in the operational amplifier OP3, and the signal is sent to an output terminal Out.

Further, the microphone amplifier unit 11 includes a direct current power supply Eo of 48 V, for example, which functions as a phantom power supply. This direct current power supply Eo is sent to the terminal pins P2 and P3 through two resistances R11 and R12 of 6.8 KΩ.

That is, the direct current power supply Eo and the resistances R11 and R12 configure a power feed circuit.

A first pin P1 of the connector 12 is connected to a terminal T1 through a resistance R13. A constant voltage diode Z2 having a Zener voltage characteristic of 3.3 V is connected between the terminal T1 and the ground, for example. This terminal T1 configures a microphone detecting unit that detects the form of the microphone (the microphone of the first form or the second form) connected to the microphone amplifier unit 11 according to a case where a positive potential "H" (first detection signal) is generated in the terminal T1 as a detection signal, and a case where the positive potential is not generated (a potential generated in this case is "L" (second detection signal)).

Further, a source of a P-type MOS field effect transistor (Q11) is connected to the first pin P1 of the connector 12, and a collector of an npn-type transistor Q12 is connected to a drain of the MOS field effect transistor (Q11). Further, an emitter of the transistor Q12 is connected to the ground, and a base thereof is connected to a terminal T2.

Therefore, the transistor Q12 performs a switching operation according to the case where the positive potential "H" is input to the terminal T2, and the case where the positive potential is not input (the potential input here is "L"), and controls whether to connect the drain of the P-type MOS field effect transistor (Q11) to the ground.

Further, two bias resistances, and a collector and an emitter of an npn-type transistor Q13 are connected between the first pin P1 and the ground. A connection midpoint of the two bias resistances is connected to a gate of the MOS field effect transistor (Q11). Then, a base of the transistor Q13 is connected to a terminal T3.

Therefore, in a case where the positive potential "H" is applied to the terminal T3, a gate bias that can set the MOS field effect transistor (Q11) to an ON state can be provided.

Further, a source of a P-type MOS field effect transistor (Q14) is connected to the first pin P1 of the connector 12, and a drain of the MOS field effect transistor Q14 is connected to the ground. Then, two bias resistances, and a collector and an emitter of an npn-type transistor Q15 are connected between the first pin P1 and the ground. A connection midpoint of the two bias resistances is connected to a gate of the MOS field effect transistor (Q14). Then, a base of the transistor Q15 is connected to a terminal T4. Therefore, in a case where the positive potential "H" is input to the terminal T4, a gate bias that causes the MOS field effect transistor (Q14) to be the ON state is provided.

The terminals T1, T2, T3, and T4 are connected to an appropriate control unit 15 that functions as the above-described control means The control unit 15 may be included in the connecting device of the microphone, or may be included in an external another device (for example, a mixer). As the control unit, a typical configuration such as a CPU, an FPGA, or an ASIC is used.

Figure 6:
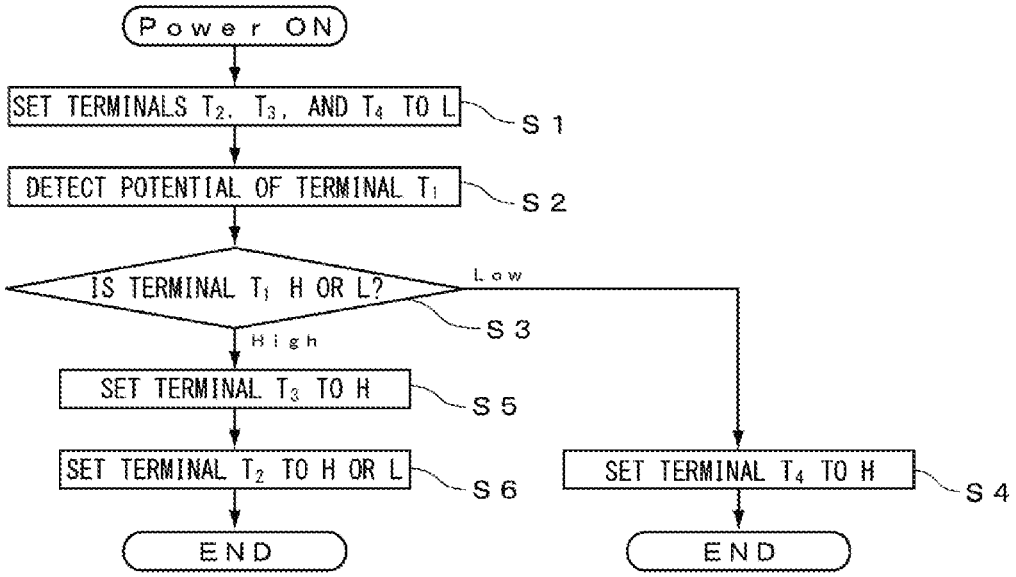
FIG. 6 is a flowchart illustrating an operation of a control unit mounted in the microphone amplifier unit, as an example of the microphone connecting device.

FIG. 6 illustrates an operation flow for detecting the form of the microphone connected to the connecting device of the microphone, for example, the microphone amplifier unit 11, and executing appropriate control.

That is, as illustrated in step S1, when the microphone amplifier unit 11 is caused to be an operation state (Power ON) by the control unit 15, the terminals T2, T3, and T4 are set to "L". Therefore, both of the two MOS field effect transistors (Q11 and Q14) are caused to be an OFF state.

In this state, as illustrated in step S2, the control unit 15 receives the potential of the detection signal output from the terminal T1. When the microphone 1 of the first form illustrated in FIGS. 1 and 4 is connected to the microphone amplifier unit 11, the potential from the direct current power supply Eo appears in the terminal T1 as "H" (first detection signal) through the power supply circuit 7 and the LED (D1) mounted on the microphone 1.

When the microphone 2 of the second form illustrated in FIGS. 2 and 5 is connected to the microphone amplifier unit 11, the potential appearing in the terminal T1 is a ground potential "L" (second detection signal).

In step S3, when the potential "L" appears in the terminal T1, the microphone 2 of the second form is connected to the microphone amplifier unit 11. Accordingly, in step S4, the control unit 15 performs an operation to set the terminal T4 to "H". Therefore, both the transistor Q15 and the MOS field effect transistor (Q14) become the ON state, and the first pin P1 of the connector 12 is connected to the ground by a short circuit with the MOS field effect transistor (Q14).

With the operation setting, the first pin P1 of the microphone 2 of the second form illustrated in FIGS. 2 and 5 is connected to the ground, and the second and third pins P2 and P3 are used for the balanced output of a signal and are commonly used as feeding terminals of the phantom power supply.

Meanwhile, in step S3, when the potential "H" appears in the terminal T1, the microphone 1 of the first form is connected to the microphone amplifier unit 11. Accordingly, as illustrated in step S5, the control unit 15 performs an operation to set the terminal T3 to "H". Therefore, the gate bias that can set the MOS field effect transistor (Q11) to be ON is applied to the gate of the MOS field effect transistor (Q11), and a lighting circuit of the LED, which is an operation circuit of the notifying unit, is set to be operable.

In this state, in step S6, the control unit 15 performs an operation to set the terminal T2 to "H" or "L". That is, when "H" is input to the terminal T2, the transistor Q12 becomes the ON state. When the transistor Q12 is turned ON, the first pin P1 of the connector 12 is connected to the ground through the MOS field effect transistor (Q11) and the transistor Q12. Accordingly, the cathode of the LED (D1) mounted in the microphone 1 of the first form is connected to the ground, and the lighting circuit of the LED (D1) as an example of the operation circuit of the notifying unit causes the LED (D1) to be in a light emitting state.

When "L" is input to the terminal T2, the transistor Q12 becomes the OFF state. When the transistor Q12 is turned OFF, the cathode of the LED (D1) is separated from the GND, the lighting circuit is stopped, and the LED (D1) is put out.

Therefore, as described in the beginning, when the gooseneck-type microphone of the first form including the LED D1 as the notifying unit is used in a conference room, the terminal T3 is set to "H", so that the LED becomes a state where the LED can be lighted. Following that, "H" or "L" is input to the terminal T2, so that the LED is lighted or put out. At this time, the terminal T2 may be controlled by an operator through an external input device (not illustrated).

According to the above-described embodiment of the present invention, the output connectors of the condenser microphone 1 of the first form including the LED as the notifying unit and the condenser microphone 2 of the second form without including the LED can be commonly used with a small number of pins. That is, according to the present embodiment, the condenser microphones of the first form and the second form can be commonly used without changing the pin arrangement of a conventional connector, for example, EIAJ RC-5236.

Then, the output signals of the condenser microphones are balanced-output, and the phantom power supply can be made usable.

Further, at the side of the microphone connecting device that receives the output signals of the microphones, connection of the condenser microphone of the first form or the second form can be detected based on potential information from the direct current power supply Eo supplied to a specific terminal pin (first pin P1) of the connector. Accordingly, at the side of the microphone amplifier unit 11, appropriate circuit setting corresponding to the condenser microphones of the respective forms can be performed through the control operation of the control unit 15. Therefore, a microphone connecting device that solves the problems such as an electric shock and can be safely used, without providing a pin for control of the LED like a conventional case and with the unchanged number of pins from the conventional case, can be realized.

What is claimed is:

1. A microphone connecting device suitable to be connected to a microphone of a first form in which a light emitting body is mounted, and to a microphone of a second form in which a light emitting body is not mounted, the microphone connecting device comprising:

a microphone amplifier unit configured to receive audio signals from the microphones of the first and second forms; and a connector including terminal pins suitable to connect the microphone amplifier unit and the microphones of the first and second forms, wherein the microphone amplifier unit includes:

a power feed circuit suitable to supply a direct current power supply to the microphones of the first and second forms;

a microphone detecting unit configured to detect a connection state of the microphone of the first form or the microphone of the second form based on potential information from the direct current power supply supplied to a specific terminal pin of the terminal pins of the connector; and a control unit configured to set a lighting circuit of the light emitting body to be operable by detecting connection of the microphone of the first form, and configured to connect the specific terminal pin of the connector to the ground by detecting connection of the microphone of the second form, by the microphone detecting unit.

2. The microphone connecting device according to claim 1, wherein the microphone detecting unit outputs a first detection signal due to the microphone of the first form including the light emitting body having been connected to the connector, and the control unit operates an operation circuit of the light emitting body by receiving the first detection signal.

3. The microphone connecting device according to claim 1, further comprising:

a short circuit configured to short-circuit the specific terminal pin of the connector, wherein the microphone detecting unit outputs a second detection signal due to the microphone of the second form without the light emitting body having been connected to the connector, and the control unit sets the short circuit to be operable by receiving the second detection signal.

4. The microphone connecting device according to claim 1, wherein a hot-side signal line and a cold-side signal line are further connected to the connector, the audio signal from the microphone is balanced-output with the hot-side signal line and the cold-side signal line, and a phantom power feed circuit is configured in which power from the power feed circuit is equally divided into the hot-side signal line and the cold-side signal line and is sent to the microphone.

5. The microphone connecting device according to claim 1, wherein the terminal pins of the connector include three terminal pins.

6. The microphone connecting device according to claim 1, wherein drive power is supplied from the power feed circuit in the microphone amplifier unit to an impedance conversion circuit and the light emitting body in the microphone of the first form.

* * * * *